United States Patent [19]

Beierwaltes

[11] 3,965,697

[45] June 29, 1976

[54] COMPRESSOR AND AIR COOLING SYSTEM EMPLOYING SAME

[76] Inventor: Richard R. Beierwaltes, 513 N. 4th Ave., Maywood, Ill. 60153

[22] Filed: Nov. 8, 1974

[21] Appl. No.: 522,028

Related U.S. Application Data

[63] Continuation-in-part of Ser. No. 451,139, March 14, 1974, abandoned.

[52] U.S. Cl. ..... 62/402; 418/94; 418/196

[51] Int. Cl.[2] ..... F25D 9/00

[58] Field of Search ..... 62/81, 277, 402; 418/94, 196

[56] References Cited

UNITED STATES PATENTS

| | | | |
|---|---|---|---|
| 2,187,492 | 1/1940 | Frankenberg | 62/402 |
| 2,197,492 | 4/1940 | Dodge | 62/402 |
| 2,582,297 | 1/1952 | Thatcher | 62/402 |
| 3,297,006 | 1/1967 | Marshall | 418/94 X |
| 3,686,893 | 8/1972 | Edwards | 62/402 |

*Primary Examiner*—William F. O'Dea
*Assistant Examiner*—Ronald C. Capossela
*Attorney, Agent, or Firm*—Silverman & Cass, Ltd.

[57] ABSTRACT

A rotary type engine is modified to be used as an air compressor and the air compressor is employed in an air cooling system. In the air cooling system, the air compressor supplies compressed air to a heat exchanger which reduces the temperature of the compressed air. The cooled compressed air is allowed to expand and cool within an expansion cavity of the compressor, and the rotation of the compressor forces the cooled air to emerge from an exit port in the compressor.

9 Claims, 7 Drawing Figures

COMPRESSOR AND AIR COOLING SYSTEM EMPLOYING SAME

CROSS-REFERENCE TO RELATED APPLICATION

This application is a continuation-in-part of my copending application, Ser. No. 451,139, filed Mar. 14, 1974 abandoned.

BACKGROUND OF THE INVENTION

This invention relates to air compressors of the rotary type and air cooling systems employing such compressors. In particular, this invention relates to an air cooling system which utilizes a rotary air compressor and air as a coolant. of Compressors generally are of either the reciprocal or centrifugal type. Reciprocal type compressors require a number of reciprocating pistons and a valving arrangement for allowing entry and exit of air. The entire configuration is substantially similar to that is an internal combustion engine. Because of the greater number and complexity of parts of this type of compressor is subject to a great deal of wear, and a high breakdown rate. Additionally the number and interaction of parts results in a unit that is relatively inefficient in terms of power consumption and quite noisy.

Rotary type compressors require fewer parts but their compression efficiency is generally low because of the lack of frictional engagement between the impellers and the housing. In order to increase the compression efficiency the impellers must either be rotated at an extremely high revolution rate, or the impellers must frictionally engage the housing walls. As noted subsequently with regard to prior air cooling systems employing rotary compressors, prior rotary compressors where the compellers or vanes engaged the wall have a short life and high maintenance costs.

Air cooling systems generally comprise compressors for compressing a coolant such as Freon. Heat is removed from the compressed Freon by a heat exchanger. The compressed Freon is allowed to expand, and circulate in cooling coils. In such systems the Freon must be maintained in a closed fluid system so that leakage of the Freon is a problem. Because the efficiency of these systems is low, they consume a great deal of energy. Refrigerating systems of the type described tend to extract moisture from the air. This is undesirable because food cooled by such a system tends to dehydrate which can adversely affect the food product being cooled. These systems also have many moving parts which can increase maintenance costs due to the wear and tear of these parts, and resulted in a noisy system.

A rotary, open loop, air cooling system which utilizes air as the coolant has been developed to overcome the disadvantages of the closed fluid cooling systems. See "An Air Conditioner That Doesn't Need Freon", in *Business Week*, Aug. 25, 1973, p. 30. The rotary air conditioner described in the above mentioned publication comprises a rotor fitted with a plurality of sliding vanes. The rotor is contained in an elliptical housing. As the rotor turns, the sliding vanes slide radially in and out to adjust the elliptically varying wall configuration of the housing. Fresh air is sucked into the housing by the rotation of the rotor. The air is trapped and compressed in the decreasing space between the vanes. As the air is compressed, it heats up to a temperature of approximately 250° F. The air then is allowed to pass through a heat exchanger where it cools to ambient temperature while still remaining in a compressed state. The rotor is continually rotating and once the air has been compressed, the vanes slide radially outward to provide an increasingly larger cavity. The cool compressed air is coupled into this expanding cavity where the air expands and cools to a temperature of below 0° F.

The rotary air conditioner described above has some basic disadvantages. The sliding vanes wear as they slide back and forth in their slots. As a result, leakage occurs between cavities of the sliding vanes and the efficiency of the unit is reduced. Accordingly, the maintenance costs increase and the life expectancy decreases. Noise is also a problem due to the large number of moving parts.

A rotary engine, of the type described in U.S. Pat. No. 3,297,006, by J. W. Marshall entitled "Rotary Pumps and Engines", provides an inherently balanced engine which is very quiet and has very few moving parts. As will be shown, the structure of the rotary engine is modified according to the invention to provide an air cooling system which overcomes many of the disadvantages heretofore known in prior art air cooling systems.

SUMMARY OF THE INVENTION

In practicing this invention a compressor of the rotary type is provided for compressing air. The compressor includes a housing and at least one male rotor positioned therein having at least one cycloidal shaped lobe positioned on the rotor. A female rotor is also positioned in the housing and has at least one cavity formed therein. The male and female rotors rotate in synchronism such that the lobe is received in the cavity during rotation. A compression cavity is formed between the male lobe, the female rotor and the housing for compressing air. Coupling means are provided for coupling air to the housing and for coupling the compressed air from the housing.

In practicing this invention there is also provided an air cooling system which includes the above described air compressor. The compressed air from the compressor is coupled to heat exchange means which remove heat from the compressed air. Compressed air in the heat exchange means is coupled through coupling means to an expansion cavity formed between the male rotor lobes of the compressor. The compressed air expands and cools within the expansion cavity. The cool air is forced out of the compressor by the rotation of the male rotor.

Other embodiments of the air cooling system include first and second heat exchange cavities which alternately are coupled by the coupling means to the compressor to receive compressed air. The heat exchange cavities alternately are coupled to the expansion cavity by the coupling means to allow the cool compressed air contained within the heat exchange cavities to expand and cool.

DETAILED DESCRIPTION OF THE PREFERRED EMBODIMENT

Figure 1:
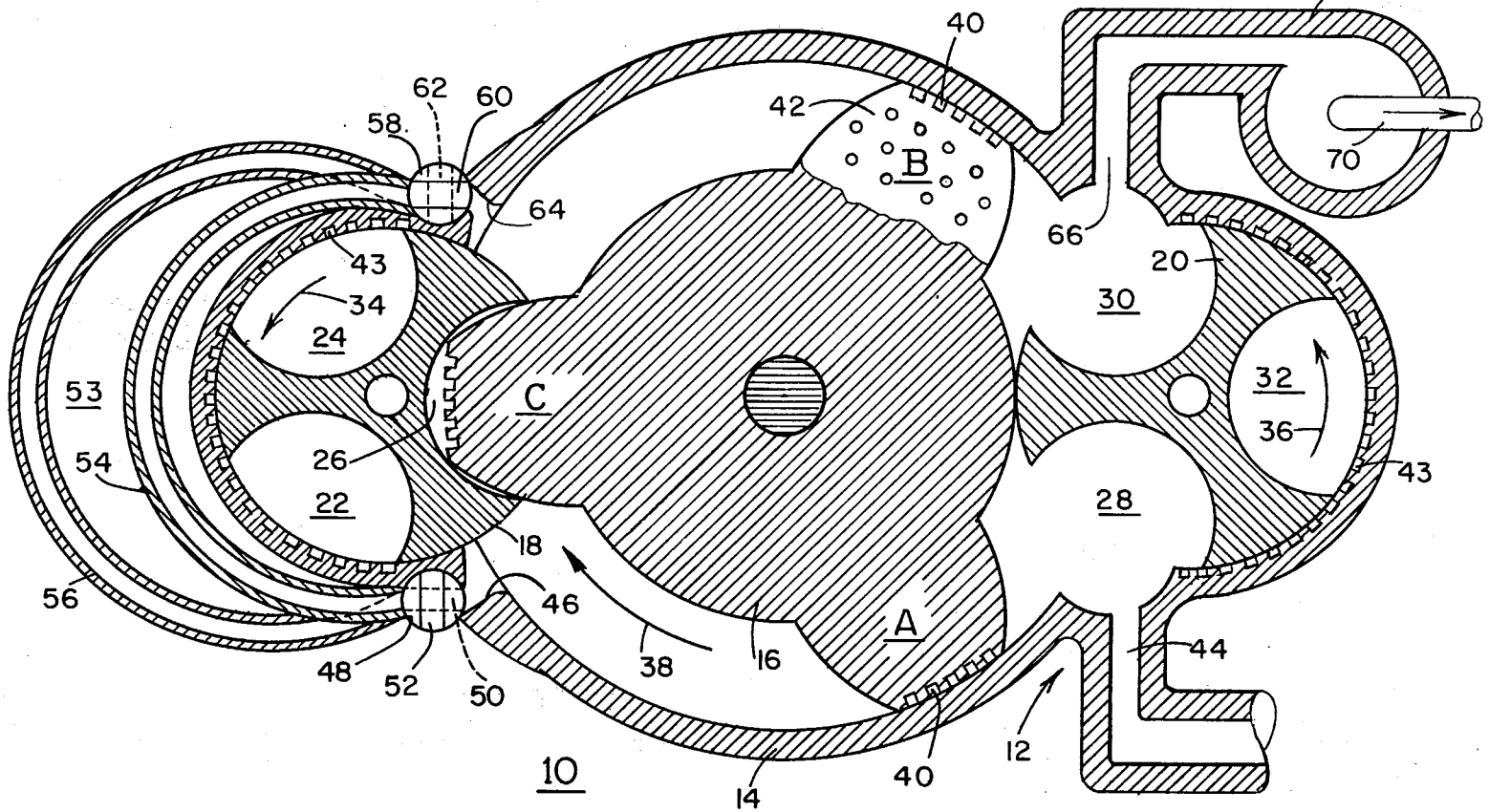
FIG. 1 is a sectional view of an air cooling system embodying the invention.

In FIG. 1 an air cooling system embodying the invention is generally indicated by the reference character 10. The air cooling system 10 includes a compressor 12 which is similar in operation and structure to the rotary type engine described in the previously mentioned U.S. Pat. No. 3,297,006. The compressor 12 is comprised primarily of a casing 14 which defines intersecting parallel cylindrical bores which house a main rotor 16, a female compression rotor 18, and a female dispelling rotor 20. All the rotors interengage with one another.

The main rotor 16 has three substantially cycloidal shaped lobes A, B, and C, disposed about the circumference of the rotor 16. The compression rotor 18 and the dispelling rotor 20 are female type rotors are disposed on opposite sides of the main rotor 16. Compression rotor 18 has a cylindrical shape with three symmetrically spaced cavities 22, 24 and 26 formed in the sidewall thereof. The dispelling rotor 20 is identical to the compression rotor 18 and includes three symmetrically spaced cavities 28, 30 and 32. The female rotors 18 and 20 turn in the same direction as indicated by the arrows 34 and 36. The direction of rotation of the main rotor 16 is indicated by an arrow 38.

The main rotor and the female rotors are all intercoupled by appropriate meshing gears (not shown) such that all three rotate at the same revolution rate. A motor (not shown) is coupled to the meshing gears intercoupling the rotors causing all three rotors to rotate in the directions indicated.

The lobes of the main rotor 16 enter into the cavities of the compression rotor 18 and the dispelling rotor 20 with approximately four to five thousandth's of an inch clearance. Accordingly, there is no actual touching of parts. The dimensions and configuration of the lobes of the main rotor and the cavities of the female rotors are such that each maintains this close running clearance both with the internal wall of the casing 14 and with the other adjacent rotors; this clearance is no greater than is necessary to obtain frictionless running and is small enough substantially to restrict air leakage. Frictionless running reduces the amount of noise associated with heretofore known air conditioning systems.

The blunt tip of each of the male lobes is serrated by forming a number of grooves therein to form a labyrinth seal 40 between the tip of the lobes and the inner wall of the casing 14. Compressed air must expand into each groove before it gets into the next groove which slows the leakage between lobes. Dimpled plates 42 on all of the lobe flanks act in a similar reverse manner to the grooves to prevent leakage. The bores in the casing 14 which house the female rotors 18 and 20, are also provided with a labyrinth seal 43 by forming a number of grooves therein to prevent leakage.

A fresh air input port 44 is provided in the casing 14 to allow fresh air to be drawn into the compressor 12 by the rotation by the main rotor 16. A compressor air output port 46 is provided in the casing to allow compressed air to be coupled to a heat exchanger selecting valve 48. Selecting valve 48 is a rotating valve which is synchronized with the rotation of the main rotor 16. The valve 48 comprises two orthogonal non-intersecting passages 50 and 52 traversing the valve 48.

A heat exchanger generally indicated by the reference character 53 is coupled to the selecting valve 48. The heat exchanger 53 is comprised of two heat exchange cavities 54 and 56 which are coupled to receive compressed air from the compressed air output port 46 through the selecting valve 48. As the selecting valve 48 rotates, passage 50 will rotate into alignment with the entrance to the heat exchange cavity 54 which couples heat exchange cavity 54 to the compressed air output port 46. Continued rotation of the selecting valve 48 decouples heat exchange cavity 54 from the port 46. Further rotation of the valve 48 aligns the passage 52 with the entrance to heat exchange cavity 56 thereby coupling the compressed air output port 46 to the exchange cavity 56.

A heat exchange releasing valve 58, identical in structure to the heat exchange selecting valve 48, is synchronized with the rotation of the selecting valve 48 and the main rotor 16. The releasing valve 58 is comprised of two orthogonal non-intersecting passages 60 and 62 traversing the valve 58. The valve 58 alternately couples the heat exchange cavities to a compressed air input port 64 in casing 14. The combination of the valves 48 and 58 allows one of the heat exchange cavities to fill with hot compressed air while the other heat exchange cavity discharges cooled compressed air, and vice versa.

A cold air output port 66 in the casing 14 couples the output of the compressor 12 to a frost remover 68 which removes frost from air coupled from compressor 12 and provides a frost-free cold air output via the conduit 70.

The above described compressor 12, in combination with the heat exchanger 53, provides the air cooling system 10 which is inherently balanced and has few moving parts. The system 10 avoids the noise problems associated with heretofore known air cooling systems. With less moving parts, the maintenance of the device is reduced. System 10 avoids the leakage problems associated with closed fluid systems in that air is being used as the coolant. System 10 consumes less energy than a closed fluid air cooling system and the volume of cold air produced is dependent upon the angular velocity of the motor driving the main rotor 16. In comparison with the prior art air cooling systems, system 10 is simple and requires less initial cost. Also, since air is used as the coolant the system 10 tends to add moisture to the volume being cooled so that dehydration of the food product being cooled is reduced substantially.

Figure 2D:
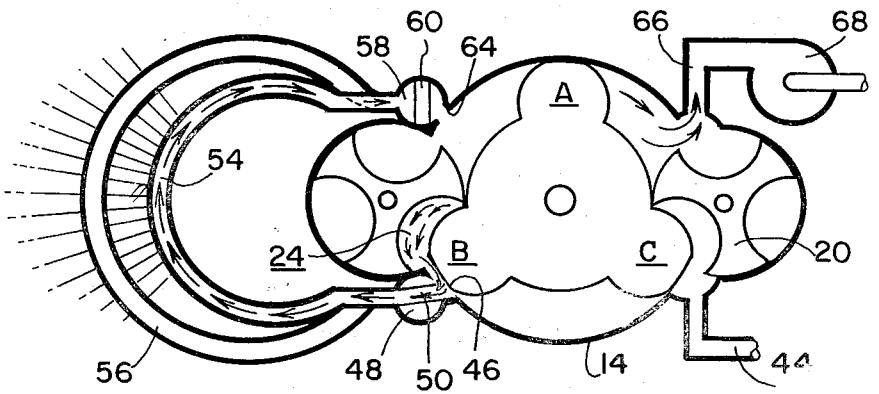
FIGS. 2*a* through 2*d* are sectional views of the system shown in FIG. 1, during different cycles of operation.
Figure 2C:
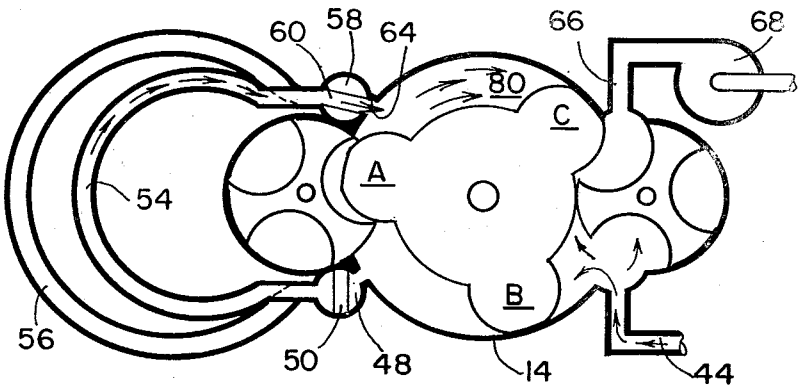
Figure 2B:
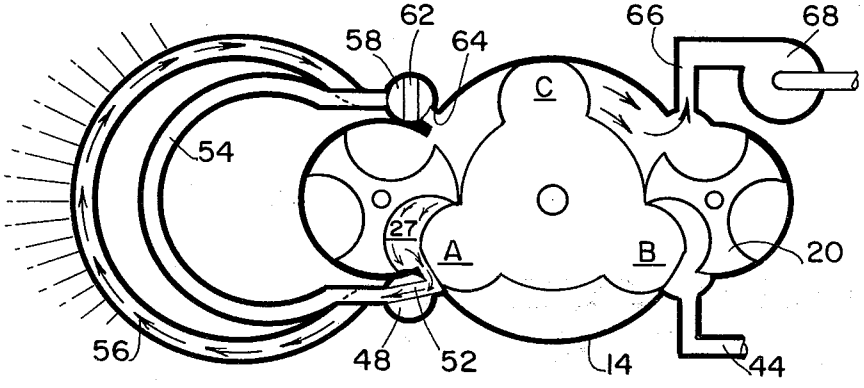
Figure 2A:
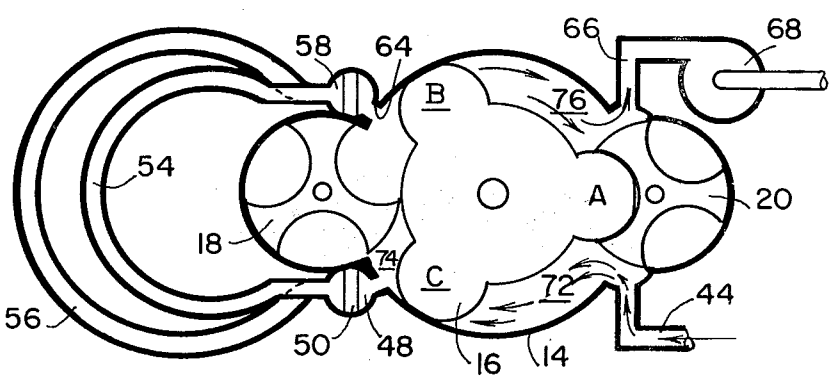

To explain the operation of the system 10, reference is made to the FIGS. 2*a* through 2*d*. In FIG. 2*a*, the intake stroke of lobe A is shown. The trailing edge of lobe C of main rotor 16 draws air from the fresh air intake port 44 into the cavity 72 formed by the trailing edge of the lobe C, the leading edge of lobe A, the dispelling rotor 20, and the casing 14.

Concurrently with the air intake stroke, the leading edge of the lobe C is compressing the air in a compression chamber 74 formed by the leading edge of the lobe C and the cavity 26 of the compression rotor 18. Continued rotation of the selecting valve 48 will allow the compressed air in the cavity 74 to be forced through the passage 50 of selecting valve 48 into the heat exchange cavity 54.

During the air intake stroke the release valve 58 rotates to a position to decouple heat exchange cavity 54 from the expansion port 64. The leading edge of lobe B is pushing air within a dispelling cavity 76 out the cold air output port 66. The expansion cavity 80 is formed between the casing 14, the trailing edge of lobe B, and the compression rotor 18. In FIGS. 1 through 2*d*, the expansion cavity 80, for simplicity is shown to have the same volume as the compression chamber 74. It is to be understood that for a practical embodiment of this invention, and for better efficiency of operation, the expansion cavity 80 can have less volume than the compression chamber 74.

FIG. 2*b* shows the compression stroke for the lobe A. The air in the cavity formed by the leading edge of lobe A and the cavity 22 of the compression rotor 18 is being compressed by the leading edge of lobe A. This compressed air can reach a temperature of approximately 250° F. The selecting valve 48 has rotated to a position to couple this hot compressed air through the passage 52 into the heat exchange cavity 56 where heat is removed and the hot compressed air is reduced to approximately ambient temperature.

During the compression stroke for lobe A the releasing valve 58 rotates to decouple the heat exchange cavity 56 from the compressed air input 64. In the chamber formed between the leading edge of lobe B, the trailing edge of lobe A, and the casing 14, the leading edge of lobe B is compressing air, and the similar chamber 80 between lobes A and C is expanding air.

The FIG. 2*c* shows the expansion stroke for lobe A. Releasing valve 58 rotates to align the passage 60 with the heat exchange cavity 54. The cool compressed air within the heat exchange cavity 54 is coupled to the compressed air input port 64. Accordingly, the cool compressed air within heat exchange cavity 54 expands and cools in an expansion cavity 80 formed by the leading edge of the lobe A, the trailing edge of the lobe C, and the casing 14. The expanding air in the cavity 80 generally drops in temperature to below 0°F. Concurrently, the trailing edge of lobe B draws in fresh air via the fresh air input port 44; the leading edge of lobe B compresses the air in the adjoining cavity.

FIG. 2*d* shows the exhaust stroke for the lobe A. The leading edge of lobe A forces the cold air through the cold air exit port 66 into the frost remover 68. The dispelling rotor 20 separates the cold air output port 66 from the fresh air input port 44. During the exhaust stroke for lobe A the releasing valve 58 rotates to a position to decouple the compressed air input port 64 from the heat exchange cavity 56 just after sealing of the cavity 24 of the compression rotor by the lobe B. Compressed air is allowed to flow into the heat exchange cavity 54 when the passage 50 is aligned with the port 46. As the main rotor continues its rotation, and after the cavity 24 is sealed by the lobe B, the releasing valve 58 rotates to align the heat exchange cavity 54 with the compressed air input port 64. Cooled compressed air, previously forced into heat exchange cavity 56 by the leading edge of lobe A and cooled to ambient temperature, is allowed to expand and cool.

Figure 3:
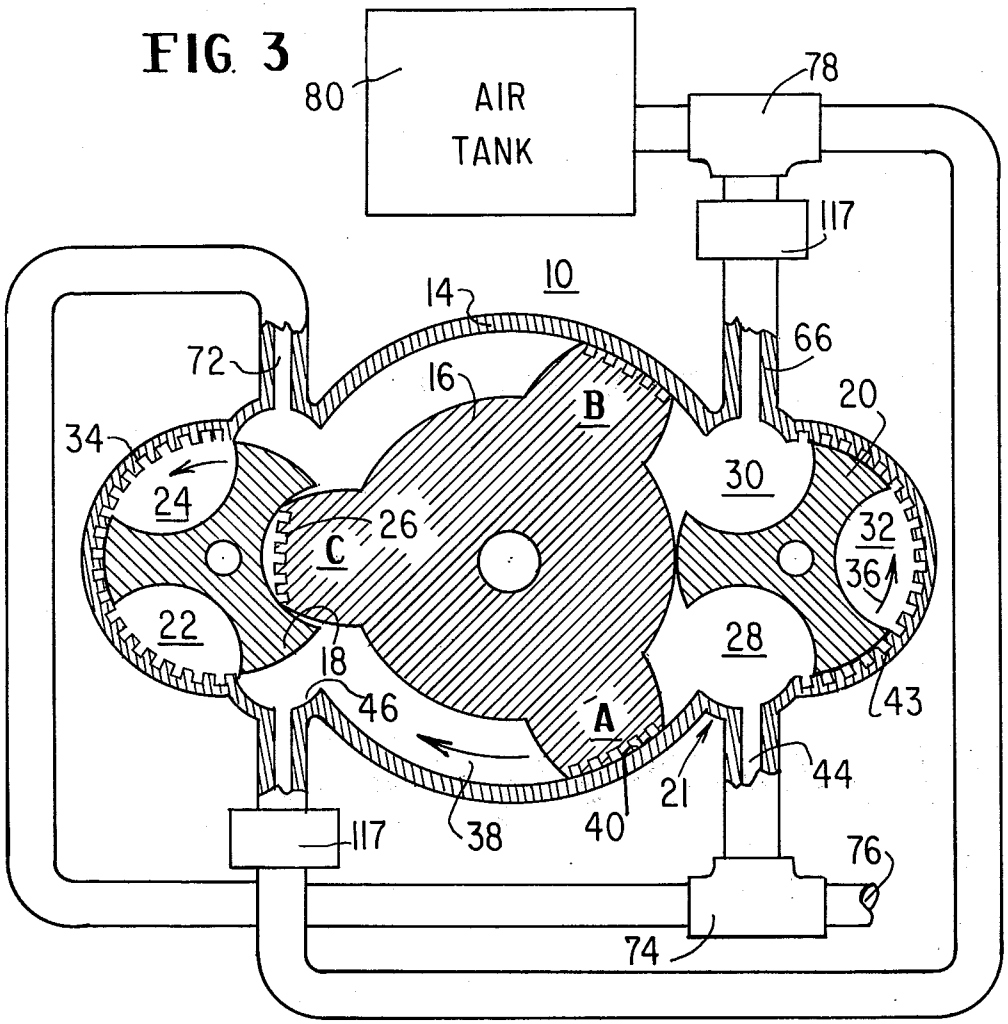
FIG. 3 is a partial sectional view of the compressor, employed in the system of FIG. 1, modified and employed as a compressor.

Referring now to FIG. 3, there is shown a compressor such as is shown in FIG. 1 which has been partially modified for operation as an air compressor. The compressor itself is identified by the number 12 as it is substantially identical to compressor 12 shown in FIG. 1. The portions of this compressor which are identical to portions of the compressor shown in FIG. 1, are labeled with the same numbers as given to the corresponding parts in FIG. 1. The operation of these parts, and the general operation of the compressor, will not be described in detail. Only modifications of the structure and operation will be described with regard to this Figure.

The heat exchanger 53 shown in FIG. 1 has been removed from the structure shown in FIG. 3. Compressed air output port 46 in FIG. 1 has been modified to be substantially the same in structure as output port 66 and is now identified with the number 70. The compressed air input port 64 shown in FIG. 1 has been modified as shown in FIG. 3 to be substantially the same in configuration as air input port 44 and is now identified by the number 72. Air input ports 44 and 72 are connected together via a T-connection 74 which has an opening 76 for receiving air and coupling the air to input ports 44 and 74. Compressed air output ports 66 and 70 are coupled together via a T-connection 78 with the T-output coupled to an air tank 80.

In operation, air enters via opening 76 and is coupled through input port 44 into the compressor 12 by rotation of the male rotor 16. This air is compressed as previously described with respect to FIGS. 1 and 2 and exits via compressed air exit port 70. The compressed air is coupled from compressed air exit port 70 to air tank 80 through T-connection 78. Air is also drawn from opening 76 through input port 72 into compressor 12 via the rotation of male rotor 16. The air is compressed by the action of the lobes on rotor 16 and female rotor 20. The compressed air exits via port 66 where it is coupled to air tank 80 via T-connection 78. A check valve 118 may be provided in exit ports 70 and 66 in order to prevent any air from feeding back from the air tank 80 into the compression chambers.

In the compressor shown in FIG. 3, two compression chambers are provided as compared to a compression and expansion chamber provided in the compressor shown in FIG. 1. Female rotors 18 and 20 act in cooperation with male rotor 16 and the walls of housing 14 to provide the air compression in the two chambers. Female rotors 18 and 20 also act to isolate these two chambers by the close fitting between the female rotors 18 and 20 and the body of male rotor 16.

Figure 4:
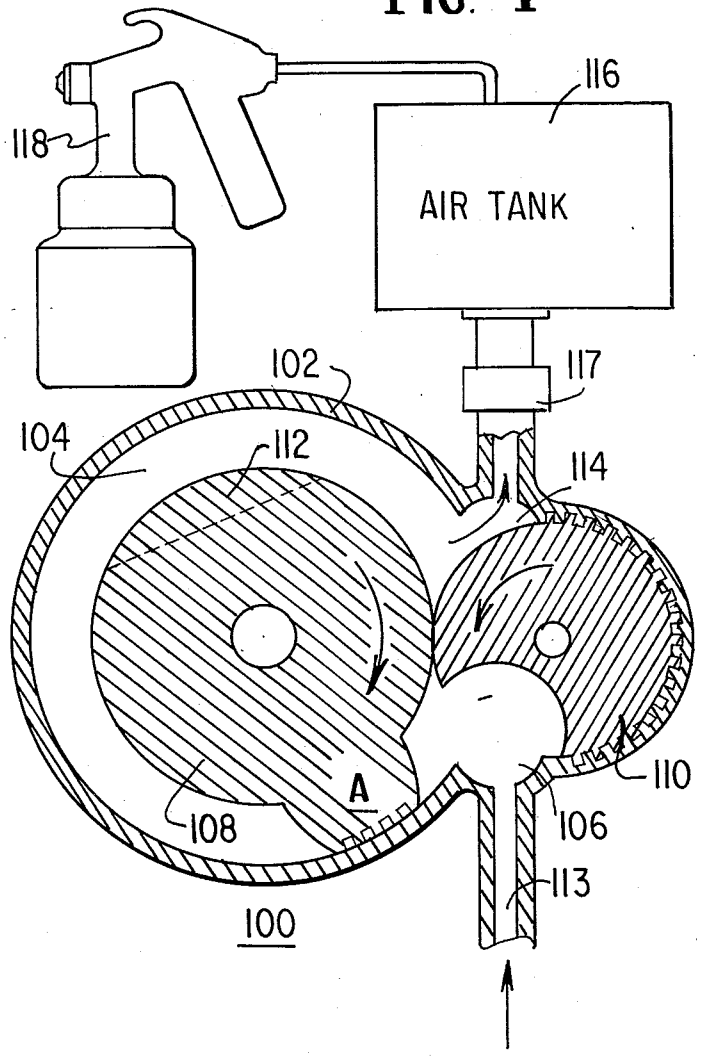
FIG. 4 is a partial sectional view of an alternate embodiment of the air compressor of this invention.

Referring now to FIG. 4, an alternate compressor embodiment is shown and is identified generally by the number 100. Compressor 100 includes a casing 102 formed from a metal such as steel or aluminum or a sufficiently strong alternate, such as plastic. The housing defines a pair of intersecting parallel cylindrical bores 104 and 106. Cylindrical bore 106 houses a male rotor 108 having a single cycloidal shaped lobe A disposed on its circumference. Cylindrical shaped bore 106 houses a female rotor 110. All of the characteristics, both physical and operational of rotors 108 and 110 are identical to rotors 16 and 18 shown in FIG. 1 including the gearing and synchronization of the two so that any further explanation need not be provided. It should be noted, however, that in order to prevent any imbalance due to the offset weighting of male rotor 108, a counterweight 112 represented by a dashed line, may be added to rotor 108 at a point diametrically opposed to lobe A.

In operation, air is drawn into bore 104 through input port 113 via the rotation of lobe A on male rotor 108. The air drawn in will be compressed by the action of lobe A and female rotor 110 on the succeeding rotation of lobe A. The compressed air exits via exit port 114 into an air tank 116. A check valve 118 may be provided in exit port 114 in order to prevent any air from feeding back into bore 104. The compressed air in tank 116 may be used subsequently for operating a number of devices such as, for example, the paint spray apparatus 118 shown in FIG. 4.

In addition to cooperating with male rotor 108 and compressing the air, female rotor 110 by its close contact with the cylindrical portions of male rotor 108, acts to provide a seal between input port 113 and exit port 114. This seal is necessary in order to provide the previously described compression function.

In the air compressor embodiments shown in FIGS. 3 and 4, a male rotor 16 was shown with three lobes and a male rotor 108 with one lobe. One embodiment showed two female rotors and the second embodiment showed a single female rotor. It is to be understood that the compressor of this invention may employ as many lobes on the male rotor, and as many male rotors, as is desirable in the specific embodiment along with as many female rotors, also with varying numbers of cavities as is desirable. When three female rotors are provided, it is of course understood that three compression chambers will be provided. The greater number of compression chambers will allow a more controlled flow rate of the compressor while still providing the same compression efficiency. An increased number of lobes on a male rotor will of course require an increased number of cavities on the associated female rotors. The increase in number of lobes can also result in an increase in compression efficiency.

In this preferred embodiment of the air cooling system, only three lobes are shown on the main rotor 16 of compressor 12. It is understood that as few as two lobes, with the associated female cavities for the compression and dispelling rotors, can be used to provide an air cooling system embodying this invention, and more than three lobes could also be used with associated female rotors and heat exchangers cooperating as described by the teachings of this invention. Other modifications readily can be made.

It is to be also understood that two compressors could be used to serve the purposes of compression and expansion rather than one as shown in FIG. 3, thus minimizing dimensional restrictions on the heat exchanger.

What it is desired to be secured by Letters Patent of the United States is:

1. An air cooling system comprising:

compression means of the rotary type for supplying compressed air and including:

a male rotor having a plurality of cycloidal shaped lobes about the circumference of said rotor;

a first female rotor coupled to said male rotor and having a plurality of cavities therein for receiving said lobes, said cavities being shaped to effect sealing with the sides of said lobes;

compression and expansion cavities being formed between said male rotor lobes, and said air cooling system further including:

heat exchange means coupled to said compression means to receive said compressed air and remove heat therefrom; and coupling means for coupling the compressed air from said heat exchange means to said expansion cavity where the compressed air is allowed to expand and cool, and for coupling the compressed air from said compression cavity to said heat exchange means.

2. An air cooling system according to claim 1, wherein:

said heat exchange means comprise first and second heat exchange cavities coupled alternately to receive the compressed air from said compression means; and said coupling means include input coupling means synchronized with said male rotor to couple alternately from said compression means the compressed air to said first and second heat exchange cavities.

3. An air cooling system according to claim 2 wherein said coupling means include output coupling means synchronized with said input coupling means alternately to couple compressed air from said second and first heat exchange cavities into said expansion cavity.

4. An air cooling system according to claim 3 wherein:

said input coupling means include a rotating valve having a configuration which defines a plurality of passages through said rotating valve, said passages are arranged to couple alternately a first port in said compression means with said first and second heat exchange cavities; and said rotating valve is synchronized with said male rotor to provide the alternate coupling prior to the sealing of one of the cavities of said first female rotor by one of said lobes of said male rotor.

5. An air cooling system according to claim 4 wherein:

said output coupling means are an output rotating valve having a configuration which defines a plurality of passages through said rotating valve, the passages are arranged to couple alternately said second and first heat exchange cavities to said expansion cavity through a second port in said compression means; and said output rotating valve is synchronized with said male rotor to provide the alternate coupling after the sealing of one of the cavities of said first female rotor by one of said lobes of said male rotor.

6. An air cooling system according to claim 2 wherein said compression means include:

a second female rotor being identical in structure to the first female rotor;

said first and second female rotors being disposed on opposite sides of said male rotor; and said first and second female rotors being coupled to rotate at an angular velocity directly proportional to the angular velocity of said male rotor.

7. An air cooling system according to claim 2 wherein said compression means include;

an output port located in said compression means to provide an exit port for the expanded cool air to pass therethrough, the expanded cool air being forced out said output port by the rotation of the forward edge of one of said lobes of said male rotor.

8. An air cooling system according to claim 7 including frost removal means for removing frost from the cold expanded air coupled to said frost means from said output port.

9. An air cooling system according to claim 2 wherein the volume of said expansion cavity is less than the volume of said compression cavity.

* * * * *